US006148828A

United States Patent [19]

Bourassa

[11] Patent Number: 6,148,828

[45] Date of Patent: Nov. 21, 2000

[54] COSMETIC DEVICE FOR DISPENSING A WIPING MATERIAL

[76] Inventor: Roger Bourassa, 57 Guilemette, St-Boniface de Shawinigan, Que, Canada, G0X 2L0

[21] Appl. No.: 09/426,318

[22] Filed: Oct. 25, 1999

[51] Int. Cl.[7] ..... A45D 29/18; B05C 17/00

[52] U.S. Cl. ..... 132/74.5; 132/73.5; 401/208

[58] Field of Search ..... 132/74.5, 73.5, 132/323, 324, 325, 73; 401/208; 15/104.94

[56] References Cited

U.S. PATENT DOCUMENTS

| | | | |
|---|---|---|---|
| 1,365,883 | 1/1921 | Bauer | 401/208 |
| 2,381,530 | 8/1945 | Dembenski | 132/325 |
| 3,441,353 | 4/1969 | Claff | 401/208 |
| 4,112,536 | 9/1978 | Carson, Jr. et al. | 15/104.94 |
| 4,998,839 | 3/1991 | Bashir | 401/208 |
| 5,044,805 | 9/1991 | Kosteniuk et al. | 401/82 |
| 5,423,338 | 6/1995 | Hodge et al. | 132/324 |

*Primary Examiner*—John J. Wilson
*Assistant Examiner*—Robyn Kieu Doan

[57] ABSTRACT

A device for dispensing a wiping material suitable for use as a make-up applicator or a make-up remover. The cosmetic device includes an elongated casing having a wiping tip protruding from one end thereof. A slidable ribbon of wiping material is covering the wiping tip. The casing further comprise a storage compartment, a take-up compartment and a ribbon handler to advance the ribbon from the storage compartment over the wiping tip through the take-up compartment. Once the segment of ribbon covering the wiping tip is dirty, the ribbon is simply advanced to expose a new fresh portion of ribbon on the wiping tip. The ribbon is preferably saturated with a cleaning solution.

9 Claims, 4 Drawing Sheets

COSMETIC DEVICE FOR DISPENSING A WIPING MATERIAL

FIELD OF THE INVENTION

The field of the present invention could broadly be considered as accessories specially adapted for handling toilet, cosmetic or cleaning substances. More particularly, it relates to a compact device for dispensing a wiping material. This device may be suitable for use as a make-up remover, nail polish remover, makeup applicator, paint applicator, lenses cleaner, etc.

BACKGROUND OF THE INVENTION

Already known in general prior art, there are the pencil-like devices which are provided in the form of felt tip pen or applying tip unit. In general those devices comprise a casing holding an applying tip, such as a felt tip in communication with a cleaning solution in the casing. A mechanism is provided to push out the tip as it wears, such as a mechanical pencil. Examples of such devices are given in U.S. Pat. Nos. 4,389,132; 4,987,911; 5,551,789; 5,044,805 and 5,174,814.

There are also compact cosmetic devices comprising in a single casing both an applicator and a remover. Examples of such prior art devices are given in U.S. Pat. No. 3,341,884; 4,932,802 and 5,509,742.

The following documents relates to other prior art accessories adapted for handling toilet, cosmetic or cleaning substances: U.S. Pat. Nos. 3,152,352; 3,365,744; 3,807,881; 3,923,404; 4,347,010; and 5,088,849.

Although those prior art devices provide compact cosmetic devices, there is still a need for a simple portable and handy device for dispensing a wiping material, that can be convenient, cost effective and simple to use.

SUMMARY OF THE INVENTION

An object of the present invention is to provide a device that satisfies this need. More particularly, the object is to provide a device comprising a wiping tip adapted for handling toilet, cosmetic or cleaning substances which combines simplicity, durability, handiness with inexpensiveness.

In accordance with the present invention, this object is achieved by providing a device for dispensing a wiping material characterized in that it comprises:

- a ribbon of wiping material;
- a compact handleable casing comprising:
  - a storage compartment for storing an unused portion of the ribbon, the storage compartment having a ribbon outlet;
  - a take-up compartment for receiving a used portion of said ribbon, the take-up compartment having a ribbon inlet; and
  - a wiping tip protruding from the casing between the ribbon outlet and the ribbon inlet, the wiping tip being devised to receive thereon a usable portion of the ribbon of wiping material; and
- a ribbon handler to advance the ribbon from the storage compartment through the ribbon outlet over the wiping tip through the ribbon inlet then to the take-up compartment.

Preferably, the device further comprises wetting means for wetting the unused portion of ribbon.

Also preferably, the casing has an elongated shape with an upper end and a lower end, the storage compartment and the take-up compartment extending vertically side-by-side in the casing, and the wiping tip of the device protruding from the upper end of the casing.

As can be appreciated, this device is particularly suitable to be used as a cosmetic device to afford the user ease of use and elimination of all inconveniences typically related to make-up removal such as pouring liquids on pads, use and disposal of paper towels, the need to run for water, and so on.

Another advantage of a device according to the present invention is that it may have a very long life. Indeed, the life of such devices depends only on the length of ribbon provided in the storage compartment.

Furthermore, a device according to the invention is believed to be very handy and economical in cost to manufacture.

A non restrictive description of preferred embodiments will now be given with reference to the appended drawings.

DESCRIPTION OF PREFERRED EMBODIMENTS

Figure 1:
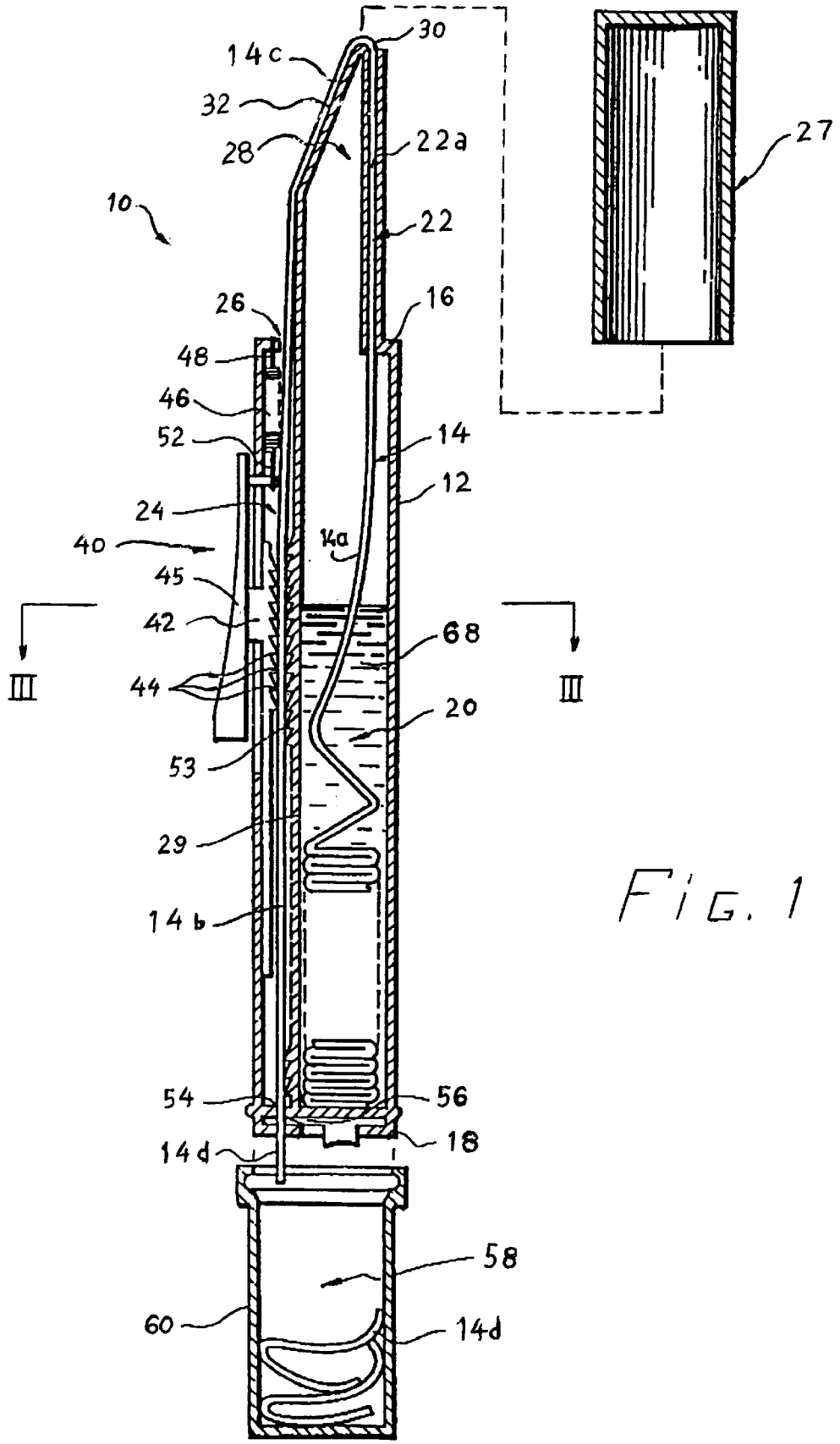
FIG. 1 is a cross-sectional side elevational view of a first preferred embodiment of a cosmetic device according to the present invention.
Figure 2:
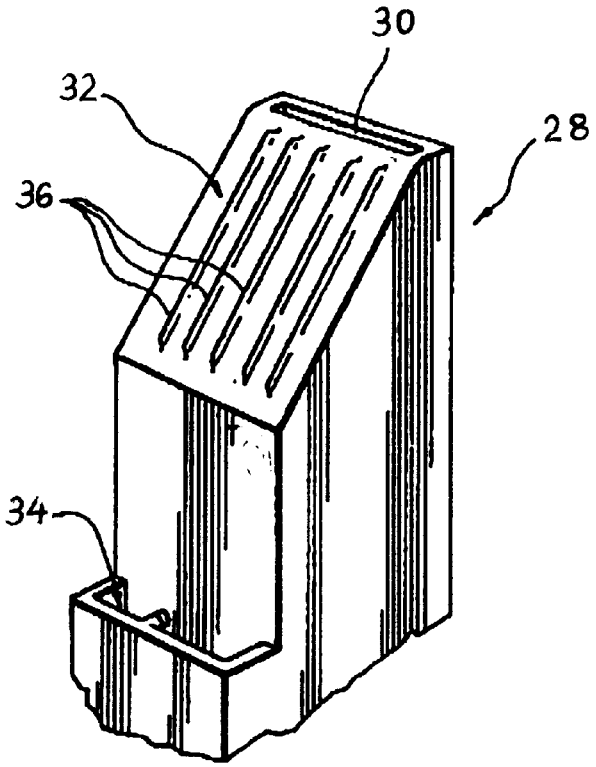
FIG. 2 is a perspective view of the wiping tip of the cosmetic device of FIG. 1 shown without the ribbon thereon.
Figure 3:
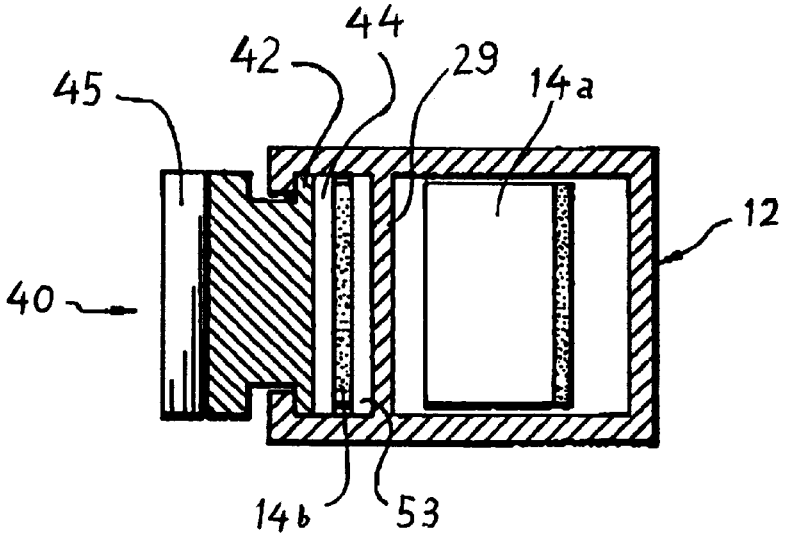
FIG. 3 is a cross-sectional view of FIG. 1 along line III—III.

Referring to FIGS. 1 to 3, a cosmetic device (10) according to a first preferred embodiment of the present invention comprises a compact handleable casing (12) provided with means for dispensing a ribbon (14) of wiping material over a wiping tip (28). This ribbon (14) may have many uses. For example, it may be suitable for removing or applying make-up, for removing nail polish, for applying paint stripper, for applying color etc. The ribbon (14) is preferably made of cloth and saturated with a cosmetic product selected from the group consisting of an eye make-up product, a face make-up product, a lip make-up product, a nail polish solution, a make-up cleaning solution and a nail polish remover solution.

The casing (12) preferably has an elongated shape, such as a pencil shape, with an upper end (16) and a lower end (18), as shown in FIG. 1. The cross section of this casing (15) may be rectangular, as shown in FIG. 2, or any other shape such as hexagonal, circular, triangular. It may be transparent to view the ribbon therein or opaque. The outer surface of the causing (12) may advantageously be provided with a grappling means for preventing the casing from slipping out of hand.

The casing (12) comprises a storage compartment (20) for storing an unused portion **(14*a*) of the ribbon. The storage compartment (20) is provided with a ribbon outlet (22) allowing the ribbon to exit the storage compartment (20). The casing (12) further comprises a take-up compartment (24) provided with a ribbon inlet (26) for receiving a used portion (14***b*) of the ribbon. Between the ribbon outlet (22) of the storage compartment (20) and the ribbon inlet (26) of the take-up compartment (24), the casing (12) is provided with a wiping tip (28). This wiping tip (28) is devised to receive thereon a usable portion (14*c*) of the ribbon. As mentioned before this usable portion (14*c*) may have many uses, namely for removing make-up. The wiping tip (28) is preferably wedge-shaped for ease of application.

A cap (27) may be provided to cover the wiping tip (28) when the cosmetic device is stored.

The cosmetic device (10) further comprises a ribbon handler (40) to advance the ribbon (14) from the storage compartment (20) through the ribbon outlet (22) over the wiping tip (28) through the ribbon inlet (26) then to the take-up compartment (24). The ribbon handler (40) will be more fully described further in the following description.

In the preferred embodiment illustrated in FIG. 1, the storage compartment (20) and the take-up compartment (24) extend vertically side-by-side in the casing (12). A partition wall (29) inside the casing (12) divides the casing (12) in these two compartment (20, 24). As shown in FIG. 1, the wiping tip (28) is positioned at the upper end (16) of the casing (12) and is preferably wedge-shaped to ease application.

Referring to FIGS. 1 and 2, a narrow passage (22*a*) extending on one side of the wedge-shaped wiping tip (28) defines the ribbon outlet (22) of the storage compartment (20). This passage (22*a*) connects the storage compartment (20) with a first slit (30) provided in the upper surface (32) of the wiping tip (28). The ribbon inlet (26) of the take-up compartment (24) is defined by a second slit (34) provided at the base of the wiping tip (28), as shown in FIG. 2. Preferably, the upper surface (32) of the wiping tip (28) which is devised to receive thereon the usable portion (14*c*) of ribbon is also provided with serration (36), as shown in FIG. 2, to ensure that the ribbon (14*c*) will not slide sideways during use.

Referring to FIGS. 1 and 3, the ribbon handler (40) preferably comprises a grappling element (42) longitudinally slidable inside the take-up compartment (24) and having at least one tooth (44), preferably a plurality, projecting downwards to grapple and advance the ribbon (14*b*) therein as the grappling element (42) is brought downwards. The ribbon handler (40) further comprises a longitudinally movable slider (45) mounted outside the casing (12). The slider (45) is operatively coupled with the grappling element (42) for moving the grappling element (42) upwards and downwards in the take-up compartment (24). As can be appreciated, as the slider (45) is manually engaged, the teeth (44) of the grappling element (42) grapple the ribbon (14*b*) and as the slider (45) is brought down wards the ribbon (14*b*) is also advance of downwards, thereby dispensing a new usable segment of ribbon (14*c*) on the wiping tip (28).

Advantageously, the ribbon handler (40) further comprises biasing means for biasingly bringing back the slider (45) upwards.

The biasing means may comprise a spring element (46), preferably an helicoical spring, or an elastic, inside the casing (12) having an upper end (48) secured to an inner wall of the casing (12) above the grappling element (42) and a lower end (52) secured to the grappling element (42).

As illustrated in FIG. 1 and in order to prevent the ribbon (14*c*) in the take-up compartment (24) to move upwards, the partition wall (29) may also be provided with downwards projecting teeth (53) on the take-up compartment side (24).

In anther preferred embodiment (not illustrated), the ribbon handler may also comprises an electric motor powered by an electric battery or a solar battery.

Furthermore, in another preferred embodiment (not illustrated), the device (10) may advantageously further comprise a second ribbon handler to move back the ribbon. This second ribbon handler could be very useful if the ribbon has been advanced too far away.

The take-up compartment (24) of the first preferred embodiment further comprises a ribbon outlet (54) to evacuate an excess of ribbon (14*d*) therein. A cutter (56) is provided at this ribbon outlet (54) to cut the excess of ribbon (14*d*). A sharp blade may be used as the cutter (56). Advantageously, the casing (12) may further comprises therein a refuse compartment (58) having an inlet connected to the ribbon outlet (54) of the take-up compartment (24) for receiving and storing the excess of ribbon (14*d*). The refuse compartment (58) is preferably removable from the casing (12) for enabling the user to empty the refuse compartment (58 when it is full. Most preferably, the refuse compartment (58) consist of a cap (60), adjustable either by screwing or clamping to the lower end (18) of the casing (12). The casing (12) and the cap (60) may be made of a transparent or semi-transparent material which could give the user an instant visual clue of the content of the cap (60).

Although, the cosmetic device (10) according to the present invention could be use with a dry ribbon, it is believed that it could have more uses if the device (10) further comprises wetting means for wetting or saturating the unused portion of ribbon (14*a*) before dispensing it on the wiping tip (28). Therefore, the preferred embodiments illustrated in FIGS. 1, 4 and 5 are each provided with such wetting means.

Referring to FIG. 1, the wetting means of the first preferred embodiment comprise a liquid (68) filling at least a portion of the storage compartment (20). The storage compartment (20) may be almost completely filled with the liquid (68), as shown in FIG. 1. In another preferred embodiment (not illustrated), the storage compartment (20) may comprise therein a sub-compartment filled with a liquid, the ribbon crossing this sub-compartment.

The ribbon (14) could also be saturated with a cleaning solution or a make-up product before it is inserted in the storage compartment (20) during the assembling of the cosmetic device (10).

Figure 4:
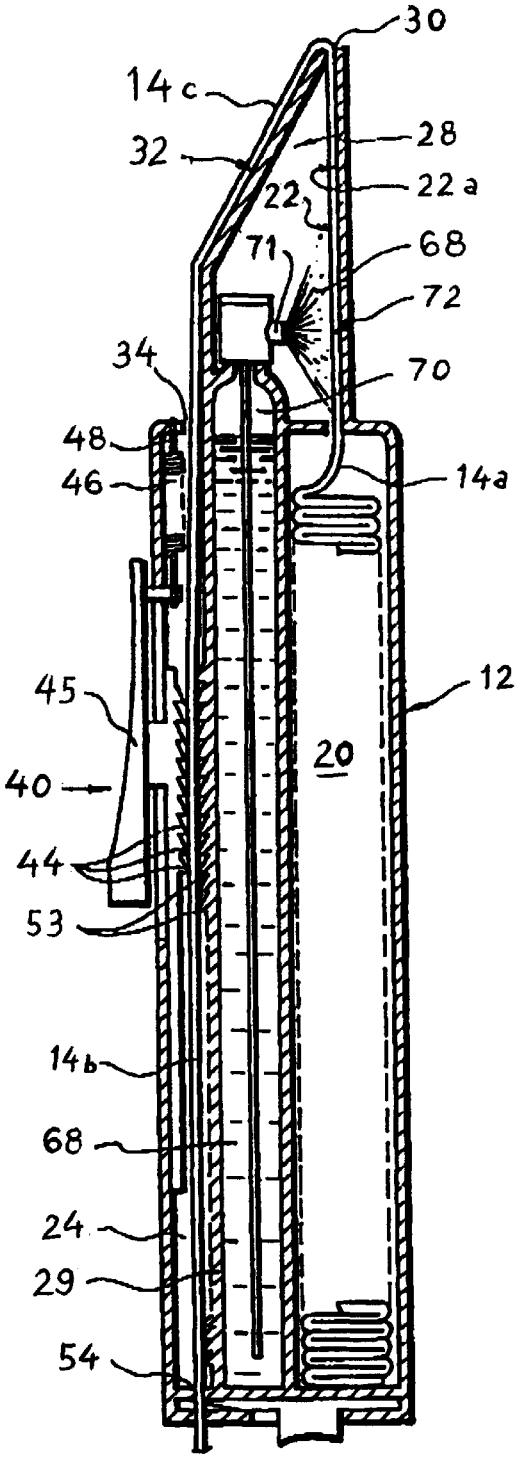
FIG. 4 is a cross-sectional side elevational view of a second preferred embodiment of a cosmetic device according to the present invention shown without the refuse compartment.
Figure 5:
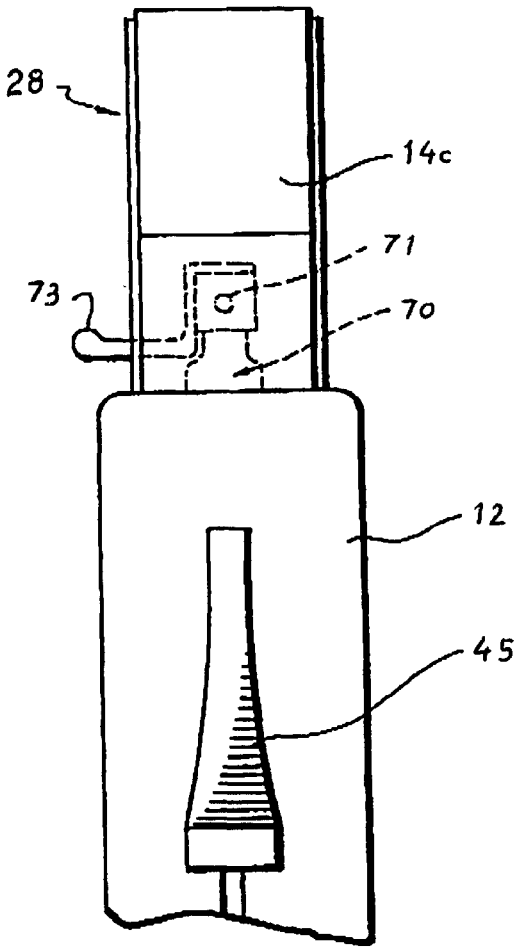
FIG. 5 is a front view of portion of the cosmetic device shown in FIG. 4.

Referring to FIGS. 4 and 5, the second preferred embodiment of a device (10) according to the present invention is very similar to the first preferred embodiment described hereinbefore, except that in this case the wetting means comprise an atomizer (70) inside the casing (12) having a nozzle (71) near the ribbon outlet (22) of the storage compartment (20) for spraying a jet of liquid on a segment (72) of the unused portion of ribbon (14*a*). A manually operable spray handle (73) is operatively connected to the atomizer (70) to actuate the atomizer (70).

Figure 6:
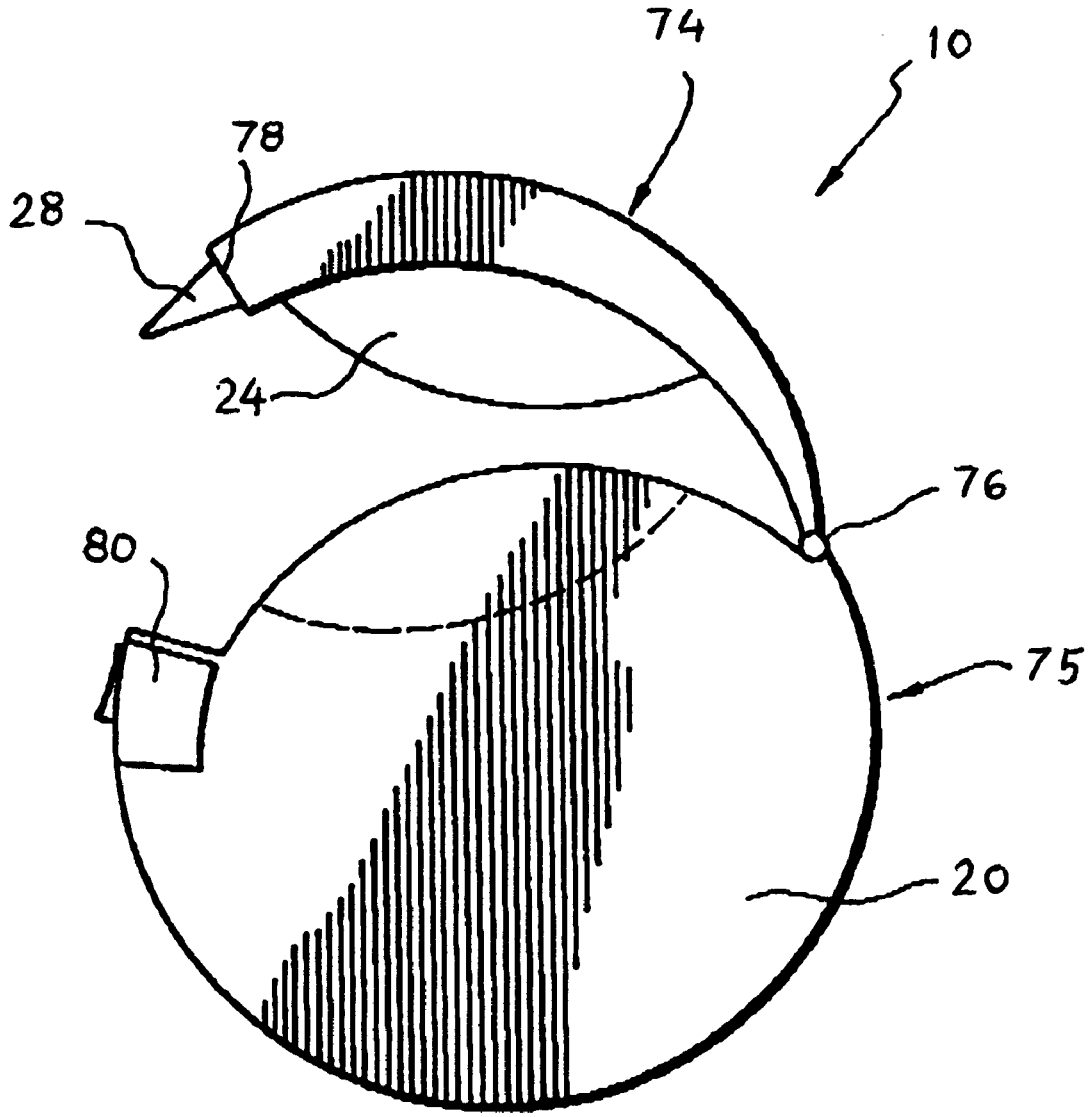
FIG. 6 is side elevational view of a third preferred embodiment of a cosmetic device according to the present invention.

Referring to FIG. 6, a cosmetic device (10) according to a third preferred embodiment is illustrated. In this case, the cosmetic device (10) comprises a substantially flat casing having a circular shape. The casing comprises a sealed main body (75) and a flapping cover (74) having a first end (76) pivotally connected to the main body (75) of the casing (12). The main body comprises therein a storage compartment (20) for the unused portion of ribbon, this storage compartment (20) taking almost all the space in the main body. The flapping cover (74) includes therein the take-up compartment (24), the wiping tip (28) protruding at a second end (78) of the cover (74). The flapping cover (74) is pivotable between a close position (not illustrated) where it flaps over the main body (75) of the casing for storing the device (10)

and an open position as illustrated for using the device (10). The main body (75) comprises a slide off cap (80) that protects the wiping tip (28) when the cover (74) is in the closed position.

For any of the preferred embodiments described hereinbefore, the liquid for wetting the ribbon is preferably selected from the group consisting of a cleaning solution, a nail polish solution, a nail polish remover, a make-up remover, a make-up product, a lip make-up product, etc.

Although preferred embodiments of the invention have been described in detail herein and illustrated in the accompanying drawings, it is to be understood that the invention is not limited to these precise embodiments and that various changes and modifications may be effected therein without departing from the scope or spirit of the invention.

What is claimed is:

1. A device (10) for dispensing a wiping material, the device being characterized in that it comprises:

a ribbon (14) of wiping material;

a compact handleable casing (12) comprising:

a storage compartment (20) for storing unused portion of the ribbon (14*a*), the storage compartment (20) having a ribbon outlet (22);

a take-up compartment (24) for receiving a used portion of said ribbon (14*b*), the take-up compartment (24) having a ribbon inlet (26); and a wiping tip (28) protruding from the casing (12) between the ribbon outlet (22) and the ribbon inlet (26), the wiping tip (28) being devised to receive thereon a usable portion of the ribbon (14*c*) of wiping material; and, a ribbon handler (40) to advance the ribbon (14) from the storage compartment (24) through the ribbon outlet (22) over the wiping tip (28) through the ribbon inlet (26) then to the take-up compartment (24); and, wetting means for wetting the unused portion of ribbon (14*a*); and, said wetting means comprise a liquid (68) filling at least portion of the storage compartment (20); and the casing (12) having an elongated shape with an upper end (16) and a lower end (18), the storage compartment (20) and the take-up compartment (24) extending vertically side-by-side in the casing (12), and the wiping tip (28) of the device (10) protruding from the upper end (16) of the casing (12); and, the ribbon handler (40) comprising:

a grappling element (42) longitudinally slidable inside the take-up compartment (24) and having at least one tooth (44) projecting downwards to grapple and advance the ribbon (14*b*) therein as the grappling element (42) is brought downwards; and, a longitudinally movable slider (45) mounted outside the casing (12), the slider (45) being operatively coupled with the grappling element (42) for moving the grappling element (42) upwards and downwards in the take-up compartment (24); and, the ribbon handler (40) further comprises biasing means for biasingly bringing back the slider (45) upwards; and, the biasing means comprise a spring element (46) inside the casing (12) having an upper end (48) secured to an inner wall of the casing (12) above the grappling element (42) and a lower end (52) secured to the grappling element (42); and, a ribbon outlet (54) to evacuate an excess of ribbon (14*d*) therein; and, a cutter (56) at the ribbon outlet (54) of the take-up compartment (24) to cut the excess of ribbon (14*d*).

2. A device (10) as claimed in claim 1, characterized in that the casing (12) further comprises therein a removable refuse compartment (58) having an inlet connected to the ribbon outlet (54) of the take-up compartment (24) for receiving and storing the excess of ribbon (14*d*) from the take-up compartment (24).

3. A device (10) as claimed in claim 2, characterized in that the refuse compartment (58) consists of a cap (60) adjustable to the lower end (18) of the casing (12).

4. A device (10) as claimed in claim 1, characterized in that the wetting means comprise:

an atomizer (70) inside the casing (12) near the ribbon outlet (22) of the storage compartment (24) for spraying a jet of liquid (68) on a segment of the unused portion of ribbon (14*a*); and, a manually operable spray (72) operatively connected to the atomizer (70).

5. A cosmetic device (10) as claimed in claim 1, characterized in that the take-up compartment (24) comprises:

a ribbon outlet (54) to evacuate an excess of ribbon (14*d*) therein; and, a cutter (56) at the ribbon outlet (54) of the take-up compartment (24) to cut the excess of ribbon (14*d*).

6. A cosmetic device (10) as claimed in claim 5, characterized in that the casing (12) further comprises therein a removable refuse compartment (58) having an inlet connected to the ribbon outlet (54) of the take-up compartment (24) for receiving and storing the excess of ribbon (14*d*) from the take-up compartment (24).

7. A cosmetic device (10) as claimed in claim 6, characterized in that the wetting means comprise:

an atomizer (70) inside the casing (12) near the ribbon outlet (22) of the storage compartment (20) for spraying a jet of liquid (68) on a segment of the unused portion of ribbon (14*a*); and a manually operable spray handle (72) operatively connected to the atomizer (70).

8. A cosmetic device (10) as claimed in claim 7, characterized in that the wiping tip (28) is wedge-shaped.

9. A cosmetic device (10) as claimed in claim 7, characterized in that the liquid (68) is a cleaning solution.

* * * * *